US006247959B1

(12) United States Patent
Daoud et al.

(10) Patent No.: US 6,247,959 B1
(45) Date of Patent: Jun. 19, 2001

(54) MODULAR PLUG ASSEMBLY

(75) Inventors: Bassel H. Daoud, Parsippany; David S. Kerr, Morris Plains; Christopher Helmstetter, Bridgewater; Antonio A. Figueiredo; George Debalko, both of Long Valley, all of NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/398,518

(22) Filed: Sep. 15, 1999

(51) Int. Cl.[7] ..... H01R 4/24; H01R 4/26; H01R 11/20

(52) U.S. Cl. ..... 439/409; 439/410; 439/676

(58) Field of Search ..... 439/409, 410, 439/676, 412, 413

(56) References Cited

U.S. PATENT DOCUMENTS 3,835,445 * 9/1974 Hardest ..... 339/99 R
4,875,875 * 10/1989 Archer et al. ..... 439/401
5,478,261 * 12/1995 Bogese, II ..... 439/676
5,993,264 * 11/1999 Daoud ..... 439/676

* cited by examiner

*Primary Examiner*—Michael L. Gellner
*Assistant Examiner*—Kyung S. Lee

(74) *Attorney, Agent, or Firm*—Stroock & Stroock & Lavan

(57) ABSTRACT

A modular plug assembly is provided which includes a modular plug body, and an insulation displacement connector (IDC), having a terminal body and a terminal strip. The assembly is formed to engage a wire, including a multi-conductor wire, and be inserted into a modular jack to form an electrical connection between the wire and the modular jack. Any length of wire can be used, and in the preferred embodiment of the invention, the assembly engages the wire in a toolless manner.

8 Claims, 5 Drawing Sheets

MODULAR PLUG ASSEMBLY

FIELD OF THE INVENTION

This invention relates to telephone wire connectors, and, more particularly, to modular plug assemblies.

BACKGROUND OF INVENTION

Modular plugs are well known in the prior art, such as RJ-11 type plugs and RJ45 type plugs. In connecting a telephone, computer modem, or other device requiring hard wiring to a telephone network, a multi-conductor wire having a modular plug at each end is provided, wherein one modular plug is inserted into a modular jack provided in the device (typically in the rear of the device), and the other modular plug is inserted into a modular jack (typically wall-mounted) which is part of the network. Typically, such wires are sold with a fixed length with the modular plugs being connected thereto, generally by crimping. For example, common wire lengths are three feet, six feet, nine feet and twelve feet.

Although fixed-length wires are widely used, the wires do have some shortcomings. In particular, a device may be located a distance from a network modular jack which is slightly greater than one length of wire, but considerably less than the next length of wire. For example, a device may have a modular jack which is located 6.1 feet from a network modular jack, where the device is, as a practical matter, immovable. As is readily apparent, a six-foot wire is insufficient to service this application, whereas, the next length of wire (nine-foot), although usable, defines slack which must be bundled, or somehow, accounted for. Excess wiring, including excessively slack wiring, is undesired in view of the clutter already present behind many devices, especially modem devices. Additionally, upon occasion, fixed-length prior art wires are too short to service an application.

To overcome some of the problems with the prior art, methods have been developed to splice two or more cut wires to form a wire of desired length. Splicing is often achieved by crimping which requires special crimping tools. Also, custom-length wires have been formed which are cut to the desired length and the modular plugs are crimped thereto.

SUMMARY OF THE INVENTION

To overcome shortcomings in the prior art, a modular plug assembly is provided which is adapted to receive, and grippingly engage, a wire. In the preferred embodiment, the modular plug assembly of the subject invention is caused to grip a wire in a toolless manner. As used herein, the term "toolless" indicates that an instrument or device, such as a crimping tool, screw driver, etc., beyond the components of the assembly, is not used.

The modular plug assembly preferably includes two components: a modular plug body; and an insulation displacement connector (IDC). By way of a non-limiting example, a two-conductor wire is referred to herein in describing the invention; however, as will be readily apparent to those skilled in the art, the invention is usable with wires having three or more conductors, and is also usable with a single-conductor wire.

The modular plug body is structurally and dimensionally equivalent to a standard modular plug known in the prior art, such as a RJ-11 type plug or a RJ45 type plug, so as to be receivable in a standard prior art modular jack. With a two conductor arrangement, the modular plug body is formed to resemble a RJ-11 type plug. In contrast to prior art modular plugs, the modular plug body of the subject invention includes a passage that extends from, and through, the rear face thereof, and at least one aperture, preferably three, that extends through the bottom face of the modular plug body and into communication with the passage. The passage is configured so as to define a shoulder, whereas, each aperture defines a stop member disposed between the respective aperture and the rear face of the modular plug body.

IDC's are well known in the prior art and any design can be used with the subject invention which includes at least one terminal strip having conductor engaging arms defined at one end thereof formed both to displace the insulation of a conductor and to contact a conductive portion of the conductor. To describe the subject invention, by way of a non-limiting example, reference is made to a pivotable type IDC, known in the art as a mini-rocker type IDC, such as those sold by A. C. Egerton. Other types of IDC's can be used with the invention, including plunger type toolless IDC's, such as, for example, the SC-99 type IDC sold by Lucent Technologies. These IDC's are each provided with a terminal body that facilitates forced engagement of a conductor with the terminal strips in a toolless manner. As an alternative, no terminal body is used with the subject invention. Here, specially-crafted tools may be used to force engagement of a conductor with a terminal strip, such as, for example, the ubiquitous 66-type IDC known in the art. However, with specially-crafted tools, forced engagement of a conductor will not be achieved in a toolless manner.

Two terminal strips are provided to accommodate the two conductors. The terminal strips used with the subject invention are each formed with at least one downwardly extending lead, and preferably two. The terminal strips are mounted into the modular plug body with portions of the respective terminal strips being inserted into the passage of the modular plug body, and the respective leads being seated in the apertures adjacent to the stop members. The stop members serve to hinder the removal of the leads from the modular plug body.

The IDC is also formed with a terminal body that facilitates forced engagement of the conductors with the terminal strips. The terminal body includes a housing and a locking arm projecting therefrom. A bridge extends from the housing to define a slot with the locking arm that is dimensioned to slidably receive portions of the terminal strips. The terminal strips are disposed within the slot so as to have the respective conductor-engaging arms extend into the housing. As with all pivotable type BDC's, a pivotable body is mounted to the housing. To accommodate two conductors, two conductor-receiving channels are defined in the pivotable body. As known in the prior art, the pivotable body works to receive conductors when in an open position, and, upon pivoting closed, to force the conductors into engagement with the terminal strips within the IDC. With the pivotable body, the terminal strips are able to engage and grip conductors in a toolless manner.

The locking arm is formed with a ramped projection extending from one end thereof. To assemble the terminal body of the IDC and the modular plug body, the locking arm is inserted into the passage of the modular plug body and forced into a locked position in abutting contact with the shoulder of the modular plug body. The shoulder defined in the modular plug body coacts with the ramped projection to hinder separation of the modular plug body and the terminal body. Additionally, in an assembled state, the locking arm is disposed adjacent to the terminal strips. As a result, the terminal strips and the locking arm cooperate to hinder the removal of these elements from the modular plug body.

In one assembly procedure, the modular plug assembly is assembled by first inserting the terminal strips into the modular plug body with the respective leads being seated in the apertures of the modular plug body. Thereafter, the ramped projection of the locking arm is forcibly inserted into the passage of the modular plug body, until the ramped projection comes into a locked position, as described above. The conductors of a wire are then inserted into the pivotable body of the IDC and caused to be engaged and gripped by the terminal strips. The modular plug body is then ready to be inserted into a modular jack to create electrical connections between the modular jack and the conductors through the terminal strips.

As can be readily appreciated, the subject invention allows for a wire to be cut to any desired length and connected to a modular plug body that is insertable into a modular plug jack. Consequently, problems found in the prior art, with fixed-length cables and splicing, are avoided.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DETAILED DESCRIPTION OF THE PREFERRED EMBODIMENTS

Figure 1:
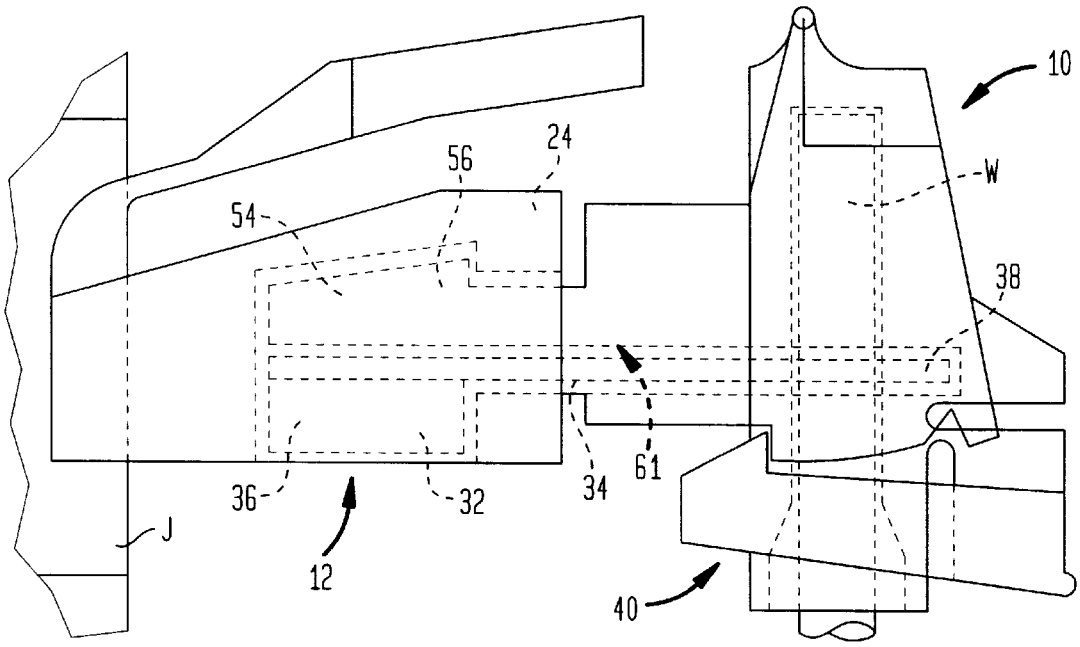
FIG. 1 is a side elevational view of an assembled modular plug assembly of the subject invention.
Figure 2:
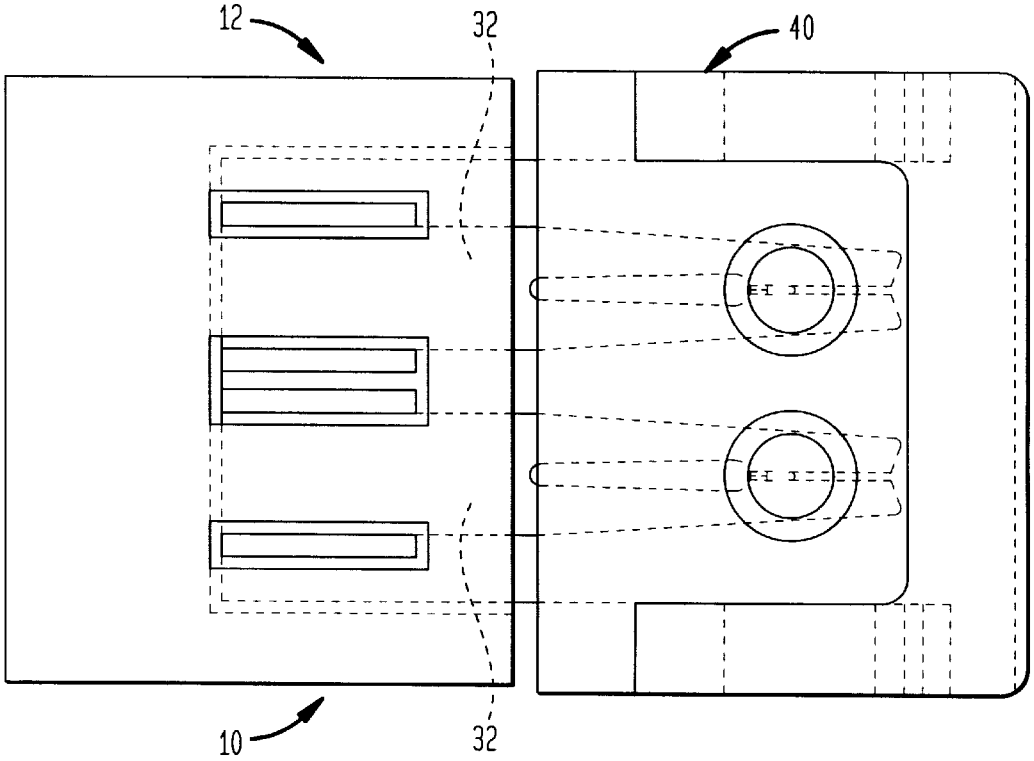
FIG. 2 is a bottom plan view of the assembled modular plug assembly.

Referring to FIGS. 1 and 2, a modular plug assembly is shown and designated with the reference numeral 10. The modular plug assembly 10 is formed to define an electrical connection between a conductor W and a modular jack J, and preferably comprises a modular plug body 12, and an insulation displacement connector (IDC) 40. By way of non-limiting example, an exemplary embodiment of the invention is disclosed herein which is formed to accommodate two conductors W and which uses a pivotable type IDC. Consistent with the spirit of the invention, any number of conductors may be accommodated, with an IDC terminal strip being provided for each conductor, and the modular plug body 12 is modified as described below. Other types of art-recognized IDCs are also usable with the invention, as a matter of design choice.

Figure 3:
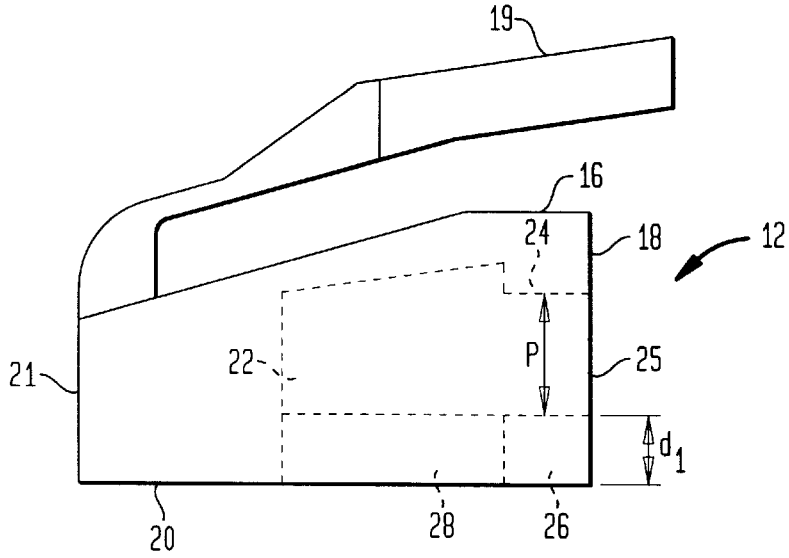
FIG. 3 is a side elevational view of a modular plug body which forms part of the modular plug assembly.
Figure 4:
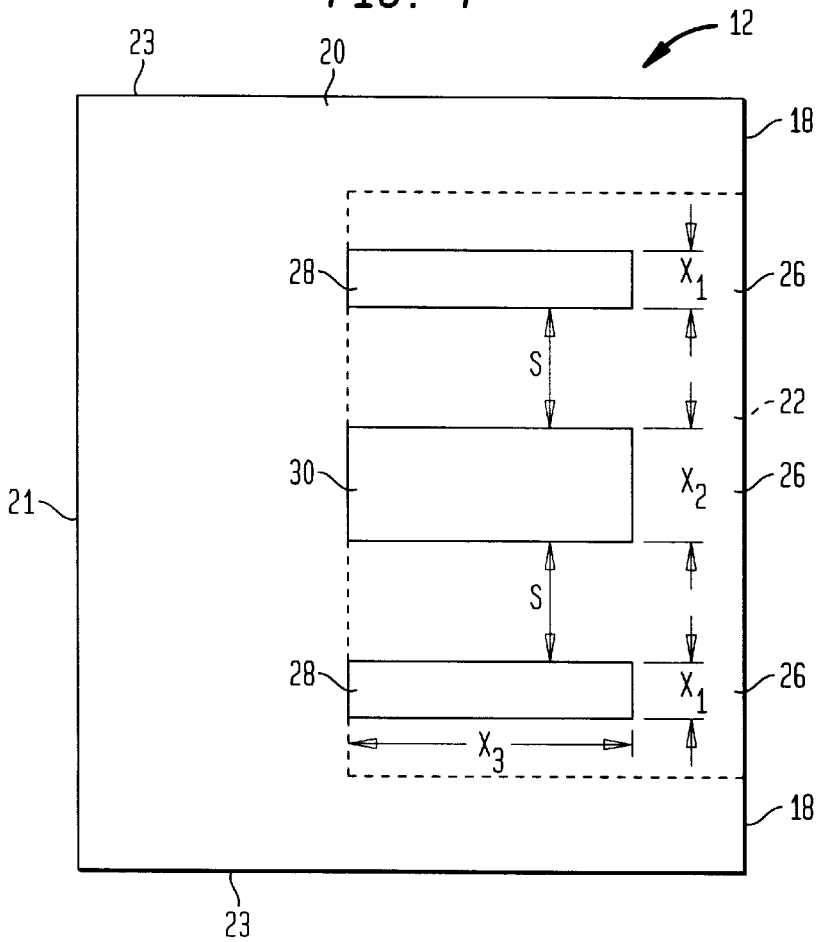
FIG. 4 is a bottom plan view of the modular plug body.

As shown in FIGS. 3 and 4, the modular plug body 12 includes a top face 16, a rear face 18, a bottom face 20, a front face 21, and side faces 23. The faces 12, 16, 18, 20, 21, 23 are sized and configured to be dimensionally equivalent to the body of a RJ-11 type plug or a RJ45 type plug, so that the modular plug body 12 can be inserted into a standard modular jack J formed to receive a RJ-11 type plug or a RJ45 type plug. In the two conductor embodiment, the modular plug body 12 is formed to resemble a RJ-11 type plug. Also, a latch 19 extends from the top face 16. Any latch design known in the prior art may be used which is capable of releasably engaging a standard modular jack J.

A rear opening 25 is defined in the rear face 18 from which extends a passage 22 into the modular plug body 12. The passage 22 defines a height P in proximity to the rear face 18, and is then enlarged within the modular plug body 12 so as to define a shoulder 24. Preferably, three apertures 28, 28, 30 extend through the bottom face 20 and into communication with the passage 22. The apertures 28, 28, 30 are arranged with the aperture 30 being a central aperture interposed between the side apertures 28. The side apertures 28 are each formed with a width X1; whereas, the central aperture 30 is formed with a width X2, which is preferably at least twice as great as the width X1. The apertures 28, 28, 30 are also each formed with a length X3. A stop member 26 is located intermediate each of the respective apertures 28, 28, 30 and the rear face 18. The stop members 26 each define a height d1, as measured between the bottom face 20 of the modular plug body 12 and the passage 22, and are spaced apart a distance S (as shown in FIG. 4).

Figure 5:
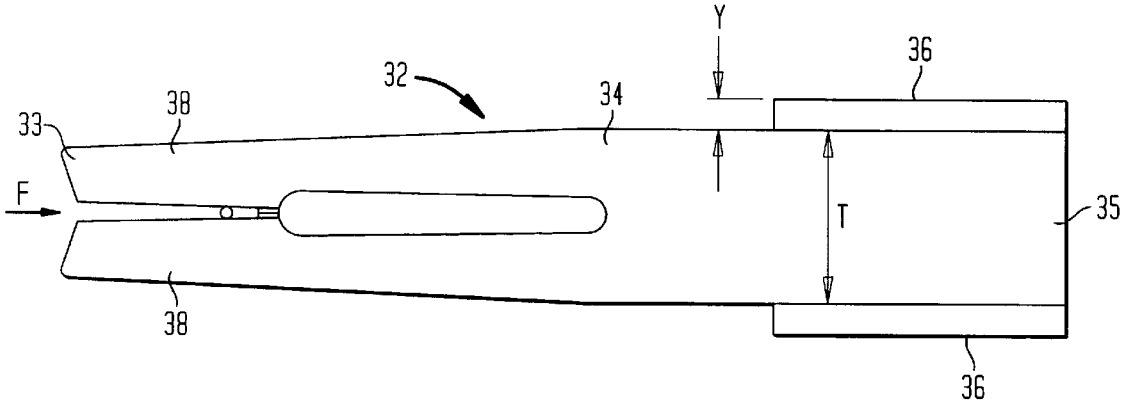
FIG. 5 is a top plan view of a terminal strip which forms part of the modular plug assembly.
Figure 6:
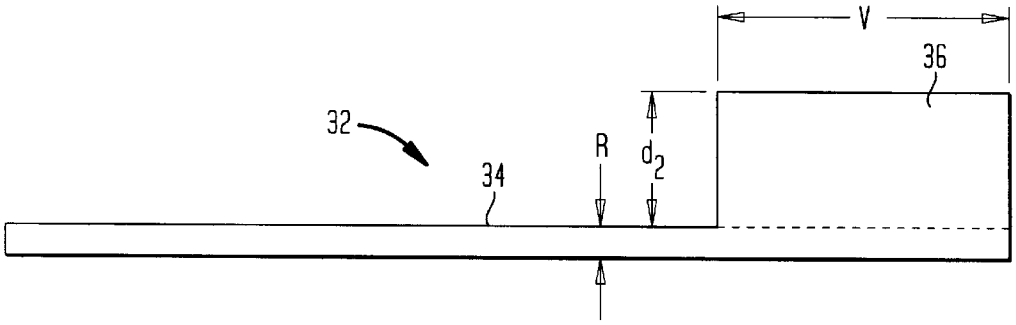
FIG. 6 is a side elevational view of the terminal strip.

FIGS. 5 and 6 show a terminal strip 32 that forms part of the IDC 40. To accommodate two of the conductors W, two terminal strips 32 are provided. The terminal strips 32 each include a base portion 34, two leads 36, and conductor-engaging arms 38. The base portion 34 is generally flat and formed to define a thickness R. The terminal strip 32 also has two ends 33, 35. At the end 35, the base portion 34 defines a width T, which is equal to, or slightly greater than, the spacing S between the apertures 28, 28, 30; the spacing T enables the leads 36 to be seated within the apertures 28, 28, 30, as described below. Also, the leads 36 are mounted to the base portion 34, at the end 35, to extend from the terminal strip 34 and be generally perpendicular thereto. The leads 36 are formed and mounted to define a height d2, as measured from the base portion 34, which is equal to or greater than the height d1, defined by the stop members 26. Also, the leads 36 are each formed with a length V which is less than the length X3 of the apertures 28, 28, 30.

The conductor-engaging arms 38 are defined at the end 33 of the terminal strip 32. Any design known in the prior art of IDC terminal strip conductor-engaging arms may be used which allows for a conductor to be engaged, with the insulation of the conductor being displaced and with contact being made with a conductive portion of the conductor. An exemplary embodiment of the conductor-engaging arms 38 is shown in FIG. 5, wherein a space is defined between the conductor-engaging arms 38 into which a conductor is forced in the direction designated with the arrow F. The spacing between the conductor-engaging arms 38 is selected such that upon forced insertion of a conductor into the space in the direction F results in the displacement of the insulation of a conductor by the conductor-engaging arms 38, and in gripping engagement of a conductive portion of the conductor by the conductor-engaging arms 38. Accordingly, the conductor-engaging arms 38 are formed to define an electrical connection with an engaged conductor.

Figure 7:
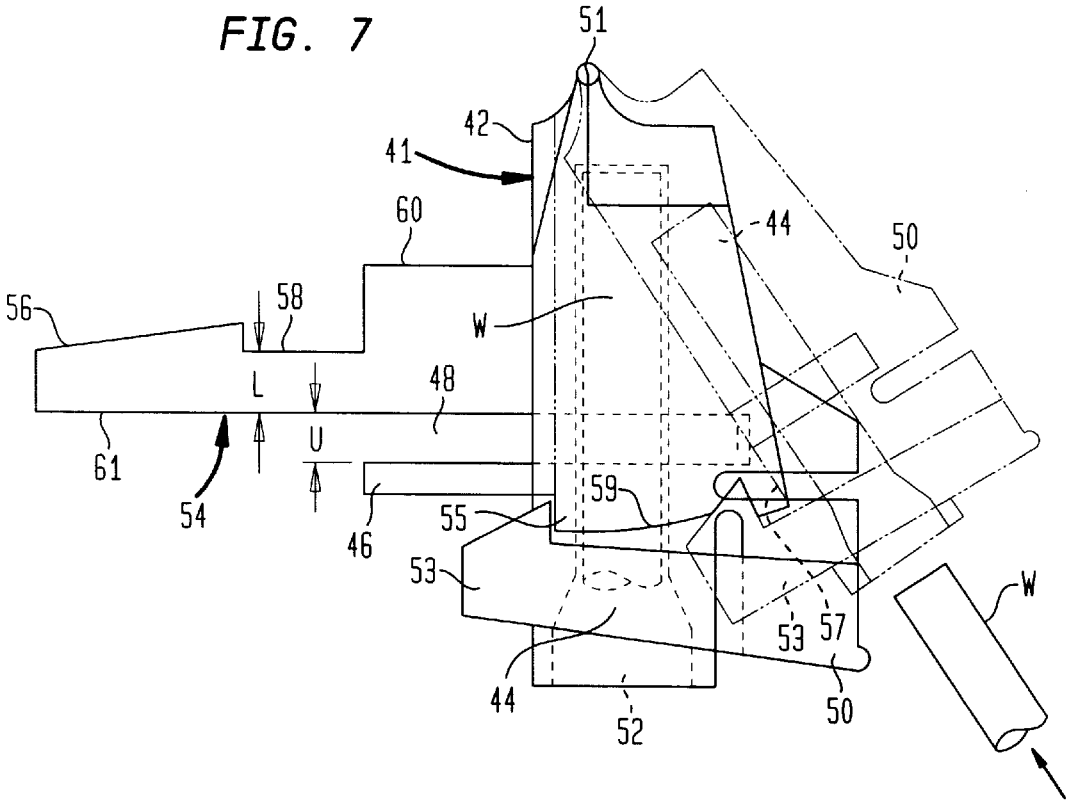
FIG. 7 is a side elevational view of a terminal body which forms part of the modular plug assembly.
Figure 8:
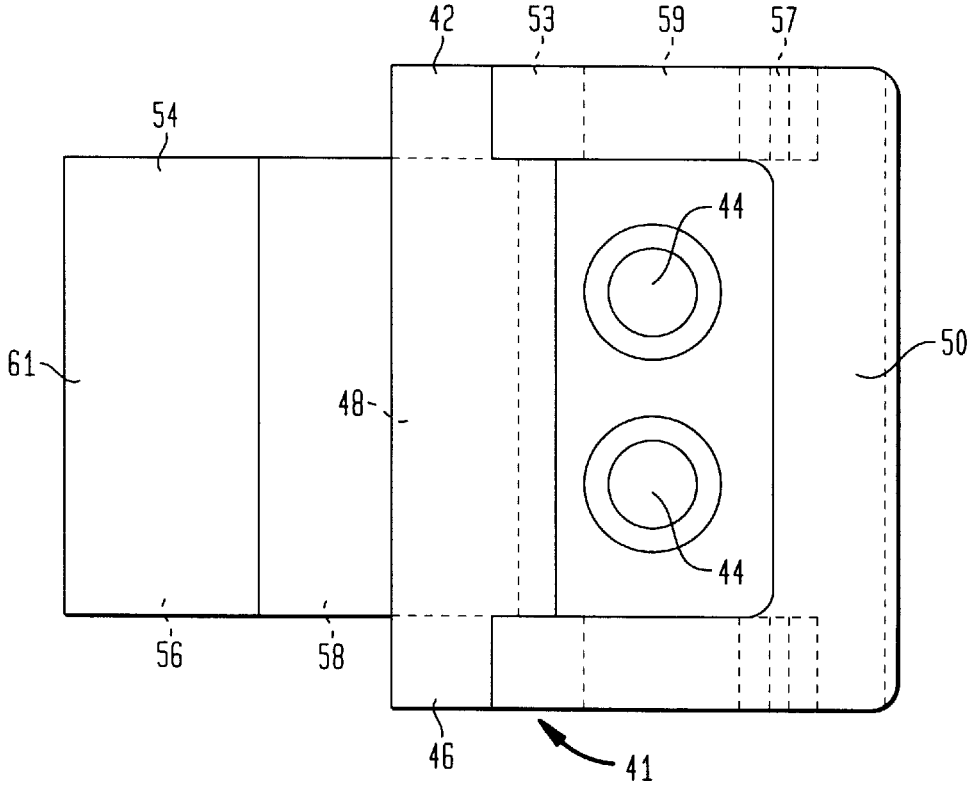
FIG. 8 is a bottom plan view of the terminal body.

FIGS. 7 and 8 show a terminal body 41 that is part of the IDC 40. The terminal body 41 is provided to facilitate forced engagement of the conductors W with the terminal strips 32 in a toolless manner. The terminal body 41 includes a housing 42 from which extends a bridge 46. The bridge 46 is disposed to define a slot 48 with the housing 42, wherein, the slot 48 defines a height U that is greater than the thickness R to allow the terminal strip 34 to be slidably received within the slot 48. In the disclosed embodiment, the terminal body 41 is formed like a terminal body of pivotable type IDC's known in the prior art, with a pivotable body 50 in which two conductor-receiving channels 44 are defined and into which the slot 48 extends to intersect the conductor-receiving channels 44. Enlarged mouths 52 of the channels 44 are provided to facilitate insertion of conductors into the conductor-receiving channels 44. As shown schematically in dashed lines, the pivotable body 50 is pivotable relative to the housing 42 about pivot 51. With this arrangement, the pivoting action of the pivotable body 50 causes toolless forced engagement of a conductor with the conductor-engaging arms 38 (not shown in FIGS. 7 and 8) of a terminal strip 32. In particular, the pivotable body 50 is pivotable from an open position (position shown in dashed lines) where the pivotable body 50 is positioned to receive conductors W within the conductor-receiving channels 44, and a closed position (shown in solid lines) where the received conductors W are disposed to intersect the slot 48. FIG. 1 shows the pivotable body 50 in a closed position with the conductor W being engaged by the conductor-engaging arms 38 of the terminal strip 32.

Referring again to FIGS. 7 and 8, the pivotable body 50 is preferably formed with a limit member 53 formed to latch onto a first catch 55 in a closed position and to latch onto a second catch 57 in an open position. The second catch 57 limits the travel of the pivotable body 50. A cambered surface 59 extends between the first catch 55 and the second catch 57 along which the limit member 53 slides during pivoting.

Figure 9:
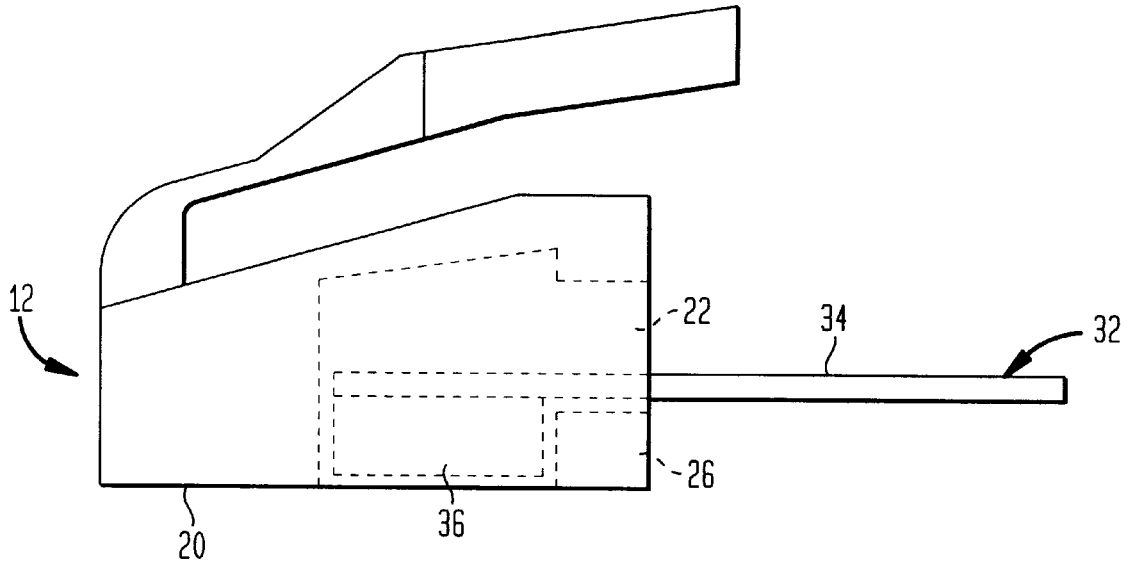
FIG. 9 is a side elevational view of the modular plug assembly partially assembled; and, FIG. 10 is a bottom plan view of the partially assembled modular plug assembly shown in FIG. 9.
Figure 10:
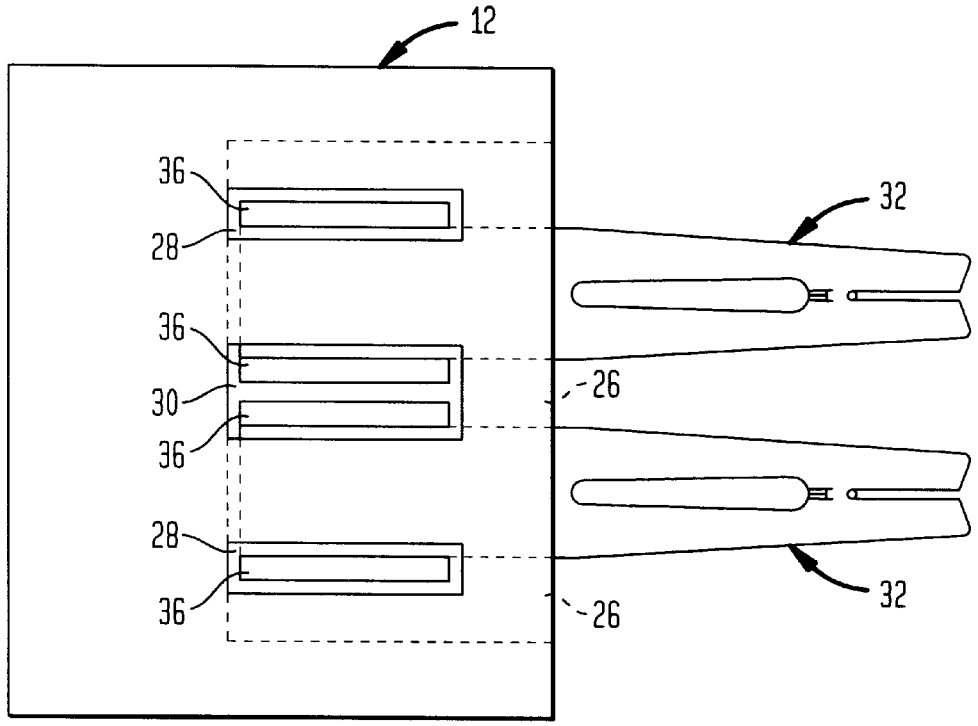

The operation and shape of the pivotable body 50 and the housing 42 are known in the prior art. With the use of this arrangement, a conductor W can be engaged by the modular plug assembly 10 in a toolless manner. Other devices, such as plunge-type devices, can be used with the subject invention with an appropriately formed terminal body being provided formed to facilitate forced engagement of conductors with the terminal strips in a toolless manner. As an alternative, no terminal body need be provided with the terminal strips 32 extending from the modular plug body 12, as shown in FIGS. 9 and 10. Adhesive, or other techniques known in the prior art, may be used to secure the terminal strips directly to the modular plug body 12. Special tools can be provided to force engagement of the conductors with terminal strips, although this procedure would not be toolless.

The terminal body 41 differs from the prior art by having a locking arm 54 extend therefrom. The locking arm 54 includes a downwardly facing engagement surface 61, a ramped projection 56, and a stop block 60. The ramped projection 56 and the stop block 60 are spaced apart to define a recess 58 therebetween. The locking arm 54 defines a width L between the recess 58 and the engagement surface 61.

To assemble the modular plug assembly 10, referring to FIGS. 9 and 10, the terminal strips 32 are inserted into the modular plug body 12, and the leads 36 are caused to be seated in the apertures 28, 28, 30. The width X1 of the side apertures 28 is greater than the thickness y of the leads 36, whereas, the width X2 is greater than twice the thickness y of the leads 36. Likewise, the length X3 of the apertures 28, 28, 30 is greater than the length V of the leads 36. As a result, as shown in FIG. 10, the leads 36 are able to seat within the apertures 28, 28,30, with one lead 36 being seated in each of the side apertures 28, and two of the leads 36 being seated in the central aperture 30.

The stop members 26 act to hinder withdrawal of the leads 36 from the modular plug body 12. Additionally, the height d2 of the leads 36, which is preferably equal to or greater than the height dl of the stop members 26, ensures that the leads 36 impinge upon an imaginary plane defined by the bottom face 20. As a result of this preferred arrangement, the leads 36 are accessible within the modular plug body 12 to form reliable electrical connections with the modular jack J.

Once the terminal strips 32 are partially disposed within the modular plug body 12, the locking arm 54 of the terminal body 41 is forcibly inserted into the passage 22 until the ramped projection 56 comes into a locked position. In a locked position, the ramped projection 56 is adjacent to the shoulder 24, as shown in FIG. 1. Also, the engagement surface 61 of the locking arm 54 is adjacent to the terminal strip 34. The sum of the thickness R of the base portion 34 and the thickness L defined by the locking arm 54 is slightly less than or equal to the width P defined by the passage 22. As such, the terminal strip 32 and the locking arm 54 cooperatively act to hold both elements within the modular plug body 12. It should be noted that the modular plug body 12, and the terminal body 40, are formed from a plastic material, which can be elastically deformed in allowing forcible entry of the locking arm 54. The terminal strip 32 is formed from a conductive material.

When assembled, the conductor W, having been cut to a desired length, can be caused to be gripped and engaged by the terminal strip 32. Thereafter, the modular plug body 12 is ready for insertion into the modular jack J to form an electrical connection between the conductor W and the modular jack J.

As a variation, in the embodiment described above, the base portion 34 of the terminal strip 32 is formed to straddle a portion of the modular plug body 12 between a pair of the apertures 28, 28, 30. With the leads 26 being seated in the apertures 28, 28, 30, the walls of the apertures coact with the leads 26 to provide lateral support to the terminal strips 32. As an alternative, the apertures 28, 28, 30 can be replaced by a single larger aperture which covers the area of all three apertures 28, 28, 30, or a combination of apertures which covers the areas of the apertures 28, 28, 30 to varying extents. As is readily apparent, with larger apertures some lateral support for the terminal strips 32 is lost, since not all of the leads 26 will be adjacent to a wall of an aperture.

The modular plug assembly 10 can be formed to accommodate any number of the conducters W. A terminal strip 32 is provided for each conductor, and, if using a terminal body 41, a conductor-receiving channel 44 is provided for each of the conductors. Also, the number of apertures 28, 28, 30 need to be adjusted accordingly. A sufficient number of apertures must be provided to allow all leads of the terminal strips to be exposed within the modular plug body to facilitate forming an electrical connection with a modular jack.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A modular plug assembly comprising:

a modular plug body formed to be releasably inserted into a modular jack; and, an insulation displacement connector mounted to said modular plug body, said insulation displacement connector having a terminal strip extending therefrom into said modular plug body, wherein said terminal strip is formed both to grippingly engage a conductor inserted into said insulation displacement connector and to form an electrical connection between the conductor and the modular jack when said modular plug body is inserted into the modular jack, wherein said modular plug body has a rear face and a passage which extends through said rear face and into said modular plug body, and at least one aperture extending through a bottom face and into communication with said passage, and wherein said terminal strip has a flat base portion with at least one lead extending therefrom, and, wherein said terminal strip is disposed in said passage of said modular plug body with said lead extending into said aperture.

2. A modular plug assembly as in claim 1, wherein said lead is formed to impinge upon a plane defined by said bottom face of said modular plug body.

3. A modular plug assembly as in claim 1, wherein said insulation displacement connector further includes a terminal body, said terminal body being formed with a locking arm having a ramped projection protruding therefrom, said locking arm being at least partially disposed in said passage of said modular plug body such that a portion of said modular plug body is interposed between said ramped projection and said rear face of said modular plug body.

4. A modular plug assembly as in claim 3, wherein said locking arm is located adjacent to said terminal strip within said passage.

5. A modular plug assembly as in claim 1, wherein said insulation displacement connector includes a pivotable body portion.

6. A modular plug assembly as in claim 1, wherein said insulation displacement connector is a toolless insulation displacement connector.

7. A modular plug assembly comprising:

a modular plug body formed to be releasably inserted into a modular jack; and, an insulation displacement connector terminal strip having first and second ends, said first end being disposed in said modular plug body, said second end extending from said modular plug body, said second end being formed both to grippingly engage a conductor forced into engagement therewith and to form an electrical connection between the conductor and the modular jack when said modular plug body is inserted into the modular jack, wherein said modular plug body has a rear face and a passage which extends through said rear face and into said modular plug body, and at least one aperture extending through a bottom face and into communication with said passage, and wherein said terminal strip has a flat base portion with at least one lead extending therefrom, and, wherein said terminal strip is disposed in said passage of said modular plug body with said lead extending into said aperture.

8. A modular plug assembly as in claim 7, wherein said lead is formed to impinge upon a plane defined by said bottom face of said modular plug body.

* * * * *